US009543714B2

(12) United States Patent
Chang

(10) Patent No.: US 9,543,714 B2
(45) Date of Patent: Jan. 10, 2017

(54) MODULAR INSERTED CONNECTOR DETECTING STRUCTURE

(71) Applicant: T-CONN PRECISION CORPORATION, New Taipei (TW)

(72) Inventor: Jen Hao Chang, Taipei (TW)

(73) Assignee: T-Conn Precision Corporation, Taipei (TW)

( * ) Notice: Subject to any disclaimer, the term of this patent is extended or adjusted under 35 U.S.C. 154(b) by 86 days.

(21) Appl. No.: 14/281,907

(22) Filed: May 20, 2014

(65) Prior Publication Data

US 2015/0318645 A1 Nov. 5, 2015

(51) Int. Cl.

| | |
|---|---|
| ***H01R 24/00*** | (2011.01) |
| ***H01R 13/703*** | (2006.01) |
| ***H01R 13/627*** | (2006.01) |
| ***H01R 24/76*** | (2011.01) |
| *H01R 12/72* | (2011.01) |
| *H01R 13/506* | (2006.01) |
| *H01R 24/60* | (2011.01) |

(52) U.S. Cl.

CPC ..... *H01R 13/7033* (2013.01); *H01R 13/6272* (2013.01); *H01R 13/7039* (2013.01); *H01R 24/76* (2013.01); *H01R 12/724* (2013.01); *H01R 13/506* (2013.01); *H01R 24/60* (2013.01)

(58) Field of Classification Search

CPC ..... H01R 13/26; H01R 13/658; H01R 23/725; H01R 23/02; H01R 23/7073

USPC ..... 439/660, 489, 607.01

See application file for complete search history.

(56) References Cited

U.S. PATENT DOCUMENTS

| | | | | |
|---|---|---|---|---|
| 4,940,430 | A * | 7/1990 | Fujitani | H01R 13/506 439/136 |
| 4,948,376 | A * | 8/1990 | Penning | H01R 13/7031 200/51.1 |
| 5,645,440 | A * | 7/1997 | Tobler | H01R 13/26 439/160 |
| 5,947,775 | A * | 9/1999 | Yamamoto | H01R 13/17 439/752 |
| 5,967,859 | A * | 10/1999 | Cecil, Jr. | H01R 13/4368 439/595 |
| 6,382,993 | B1 * | 5/2002 | Chen | H01R 12/7094 439/157 |
| 6,527,580 | B1 * | 3/2003 | Suss | H01R 4/2404 439/402 |
| 6,551,115 | B1 * | 4/2003 | Li | H01R 13/7033 200/51.1 |
| 6,764,327 | B2 * | 7/2004 | Yu | H01R 13/7033 439/188 |
| 6,869,299 | B2 * | 3/2005 | Tanaka | H01R 13/26 320/113 |

(Continued)

*Primary Examiner* — Abdullah Riyami
*Assistant Examiner* — Vladimir Imas

(57) ABSTRACT

The present invention is a modular inserted connector detecting structure, which comprises a connector (such as USB connector) having an insulation body and multiple signal terminals, wherein two sides of the insulation body may have a first and a second detection modules joined therewith, or one surface of the insulation body is provided with a detection module thereon. Thereby, in assembly, the first and second detection modules may be used to join the two sides of the insulation body directly, or a scarfing seat of the detection module may be used to join on the insulation body, in order to achieve the effects of easy structure, convenient assembly, robust joining and facility to produce and manufacture.

8 Claims, 19 Drawing Sheets

(56) References Cited

U.S. PATENT DOCUMENTS 7,207,819 B2 * 4/2007 Chen ..... H01R 13/703 439/188
7,210,945 B1 * 5/2007 Ying ..... H01R 13/502 439/79
7,413,467 B1 * 8/2008 Lai ..... H01R 13/641 439/489
7,588,470 B2 * 9/2009 Li ..... H01R 12/725 439/660
7,607,926 B2 * 10/2009 Wang ..... H01R 12/7094 200/51.1
7,727,026 B2 * 6/2010 Qin ..... H01R 13/7033 439/607.34
7,955,137 B2 * 6/2011 Ko ..... H01R 13/506 439/607.45
7,972,181 B1 * 7/2011 Zhu ..... H01R 12/724 439/660
7,989,719 B2 * 8/2011 Sun ..... H01R 13/70 200/51 R
8,047,877 B1 * 11/2011 Liu ..... H01R 13/4367 439/660
8,109,795 B2 * 2/2012 Lin ..... H01R 13/6461 439/660
8,337,254 B2 * 12/2012 Jin ..... H01R 13/642 439/660
8,690,608 B2 * 4/2014 Naito ..... H01R 13/7039 439/607.01
8,696,369 B2 * 4/2014 Mattson ..... H01R 13/6658 439/131
8,864,526 B2 * 10/2014 Kim ..... H01R 24/62 439/638
8,920,197 B2 * 12/2014 Tziviskos ..... H01R 13/405 439/660
8,956,179 B2 * 2/2015 MacDougall ..... H01R 13/641 439/489
2009/0075517 A1 * 3/2009 Li ..... H01R 12/725 439/552
2012/0322282 A1 * 12/2012 Naito ..... H01R 13/7039 439/137

* cited by examiner 19-1

19-2

MODULAR INSERTED CONNECTOR DETECTING STRUCTURE

BACKGROUND OF THE INVENTION

Field of the Invention

The invention is a modular inserted connector detecting structure, particularly a detecting structure used for an USB connector.

Descriptions of the Related Art

Generally, a conventional USB connector is usually provided with a detection terminal to detect an inserted USB plug connector in order to initiate signal transmission, turn on power supply or achieve other detection functions.

There are conventional related patent technologies, such as U.S.A. patents U.S. Pat. No. 7,607,926 B2, U.S. Pat. No. 7,727,026 B2 and U.S. Pat. No. 8,690,608 B2. However, the detection terminal of those patents is combined integrally with the insulation body of the connector directly (either in plugging or integral covering manner). Since the volume of the detection terminal is small and there are already multiple signal terminals and related mechanism designs arranged on the insulation body of the connector, as the detection terminal is combined with the insulation body in a conventional manner, there would be shortages in that the structure of the insulation body would get complex easily, the assembly of the detection terminal is more complicated, and the manufacturing for the mold of the insulation body is not facility, and so forth.

In view of above, the inventor of the present invention has made efforts to develop a modular inserted connector detecting structure in order to improve various shortages of conventional technologies as stated above.

SUMMARY OF THE INVENTION

One objective of the present invention is to achieve the effects of simple structure, convenient assembly, robust joining and facile to produce and manufacture in assembly by using the first and second detection modules for joining on two sides of an insulation body directly, or by using a scarfing seat of the detection module for joining on the insulation body directly.

In order to achieve the above objective, the present invention is a modular inserted connector detecting structure, and one embodiment thereof includes: a connector having an insulation body and multiple signal terminals; a first detection module joining with the insulation body, which comprises a first retaining bracket arranged on one side of the insulation body, and a first detection terminal provided on the first retaining bracket; and a second detection module joining with the insulation body, which comprises a second retaining bracket arranged on another side of the insulation body, and a second detection terminal provided on the second retaining bracket.

In the above embodiment, the insulation body comprises a tongue, a base connecting with the tongue, a first engagement portion provided on the base, a second engagement portion provided on the tongue, such that one end of the signal terminal is provided on the tongue, while the other end protrudes out from the base, and the first retaining bracket provided on the first detection module joins with the first engagement portion, the second retaining bracket provided on the second detection module joins with the second engagement portion, while the first engagement portion comprises a limiting area and an extending portion provided on the base and located on one side of the limiting area.

In the above embodiment, the first retaining bracket comprises a fixing portion joining with the limiting area, a vertical wall extended and provided on the fixing portion, a slot provided on one end surface of the vertical wall and butting with the extending portion, an angle block extended and provided on one side of the vertical wall and abutting against the tongue, and a mounting portion extended and provided on one side of the vertical wall and abutting against the base, while the first detection terminal comprises a connection section in a bending form, a contact end provided on one end of the connection section, and a soldering end provided on the other end of the connection section, the connection section is provided in the mounting portion, the contact end protrudes out from the mounting portion and corresponds to the angle block, and the soldering end protrudes out from the mounting portion and is in the same direction as the vertical wall.

In the above embodiment, the second engagement portion comprises a recess area provided on one side of the tongue, a bump provided in the recess area, and fastening troughs provided on both surfaces of the tongue and adjacent to the bump, respectively, and the second retaining bracket comprises a clamping portion, a vertical wall provided on one side of the clamping portion, and a mounting portion provided on one side of the vertical wall, while the clamping portion is joined in the recess area of the second engagement portion, and clamps the bump and is snapped in each of the fastening troughs.

In the above embodiment, the second detection terminal comprises a connection section in a bending form, a contact end provided on one end of the connection section, and a soldering end provided on the other end of the connection section, the connection section is provided in the mounting portion, and the contact end protrudes out from the mounting portion and corresponds to the clamping portion, while the soldering end protrudes out from the mounting portion and is in the same direction as the vertical wall, and the clamping portion comprises a side slab, an upper slab provided on one side of the side slab, a lower slab provided on one side of the side slab and corresponds to the upper slab, a butting area formed between the upper slab and the lower slab, and an upper hooking block and a lower hooking block provided on corresponding surfaces of the upper slab and the lower slab, respectively, such that the upper hooking block and the lower hooking block snap each of the fastening troughs after the butting area clamps the bump, respectively.

Another embodiment includes: a connector (such as USB connector) with an insulation body and multiple signal terminals; and a detection module joining with the insulation body, which comprises a scarfing seat arranged on one surface of the insulation body, and two detection terminals provided on two sides of the scarfing seat, respectively.

In the second embodiment above, the insulation body comprises a tongue, a rabbet provided on one surface of the tongue, a base connecting with the tongue, multiple separation portions provided on the base, and engagement troughs provided on two sides of the base, such that one end of the signal terminal is provided on the tongue, and the other end protrudes out between the separation portions of the base, and the scarfing seat provided on the detection module joins with the rabbet and the engagement trough, while the engagement trough comprises a limiting area, a stopping portion provided on one inner wall of the limiting area.

In the second embodiment above, a bottom surface of the scarfing seat provided on the detection module is provided with a butting portion joining with the rabbet, and two sides of the scarfing seat are provided, respectively, with a retaining bracket joining with the engagement troughs, and multiple grooves engaged with each of the separation portions are provided on one surface of the scarfing seat, while the retaining bracket comprises a fixing portion joining in the limiting area, an extension section provided between the scarfing seat and the fixing portion and abutting against one side edge of the limiting area, and a notch provided on the top surface of the fixing portion and abutting the stopping portion, and the extension section extends toward one side of the scarfing seat, such that the fixing portion and the scarfing seat are located in different planes to make a back and front difference, in addition, the detection terminal provided on the detection module comprises a connection section, a contact end provided on one end of the connection section, a soldering end provided on the other end of the connection section, and an intervening portion provided on one side of the connection section, the connection section and the intervening portion are provided in the fixing portion, the contact end protrudes out from the fixing portion and the scarfing seat and corresponds to the extension section, and the soldering end protrudes out from the fixing portion and is in the same direction as the scarfing seat.

In the further embodiment above, a back cover is further provided on one surface of the scarfing seat, and the back cover is above each of the grooves, and multiple limiting holes for the other end of each of the signal terminals to penetrate are provided on the back cover.

In the further embodiment above, a back cover is further provided on one surface of the scarfing seat, and the back cover is above each of the grooves, and an elongated hole for the other end of each of the signal terminals to penetrate are provided on the back cover.

DETAILED DESCRIPTION OF THE PREFERRED EMBODIMENT

Figure 1:
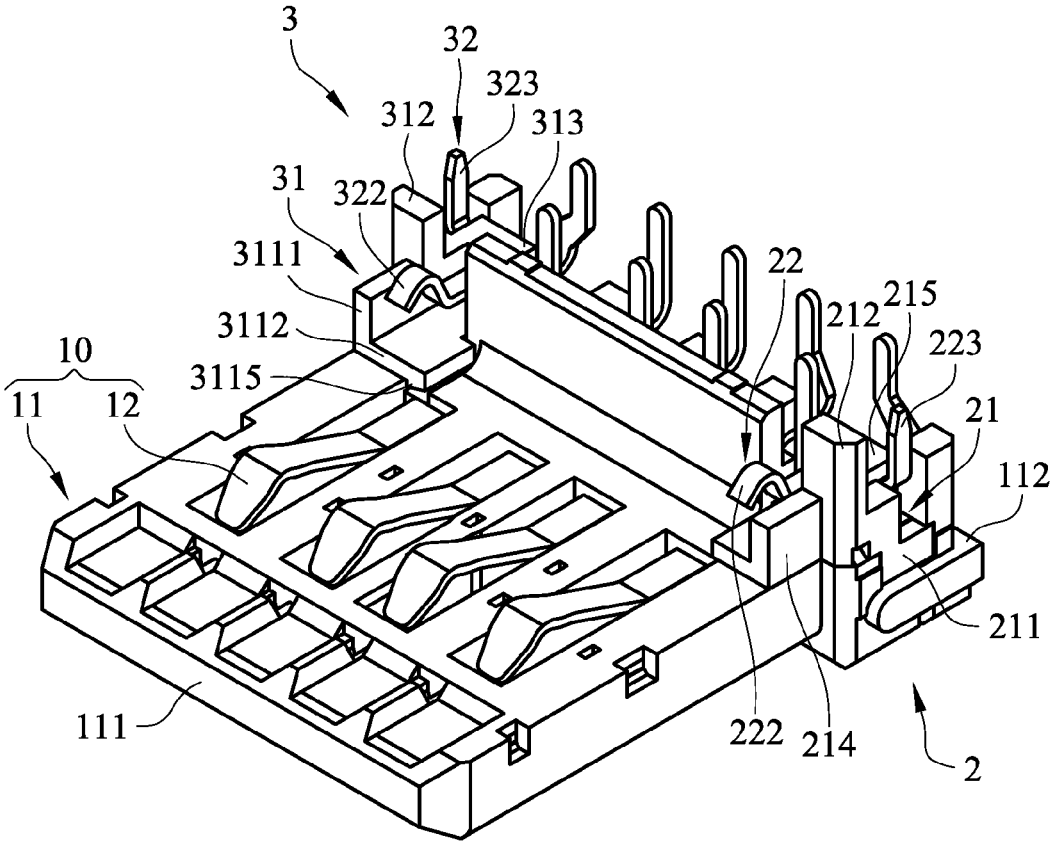
FIG. 1 is a stereo appearance schematic of the first embodiment according to the present invention.
Figure 2:
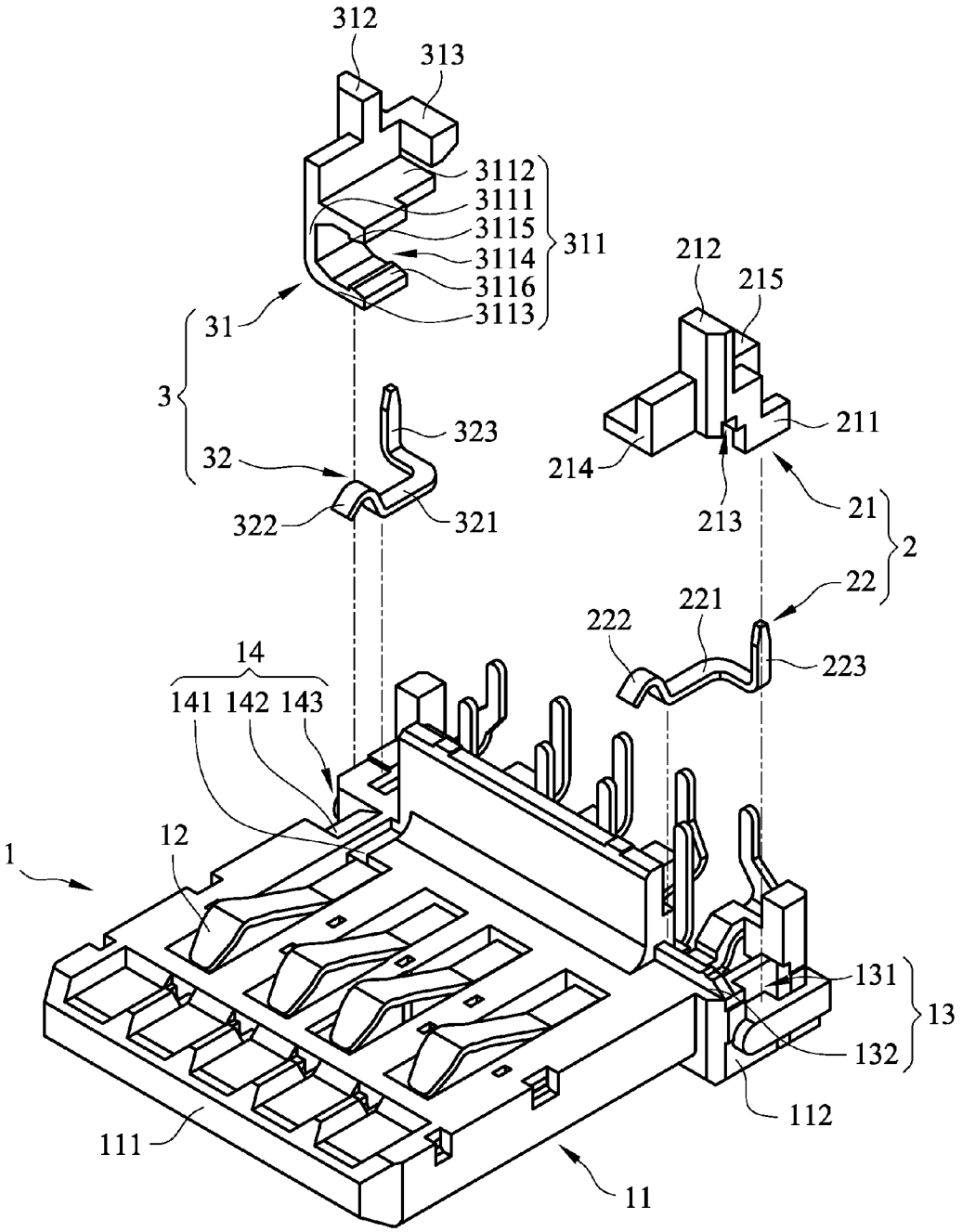
FIG. 2 is a stereo exploded schematic of the first embodiment according to the present invention.
Figure 3:
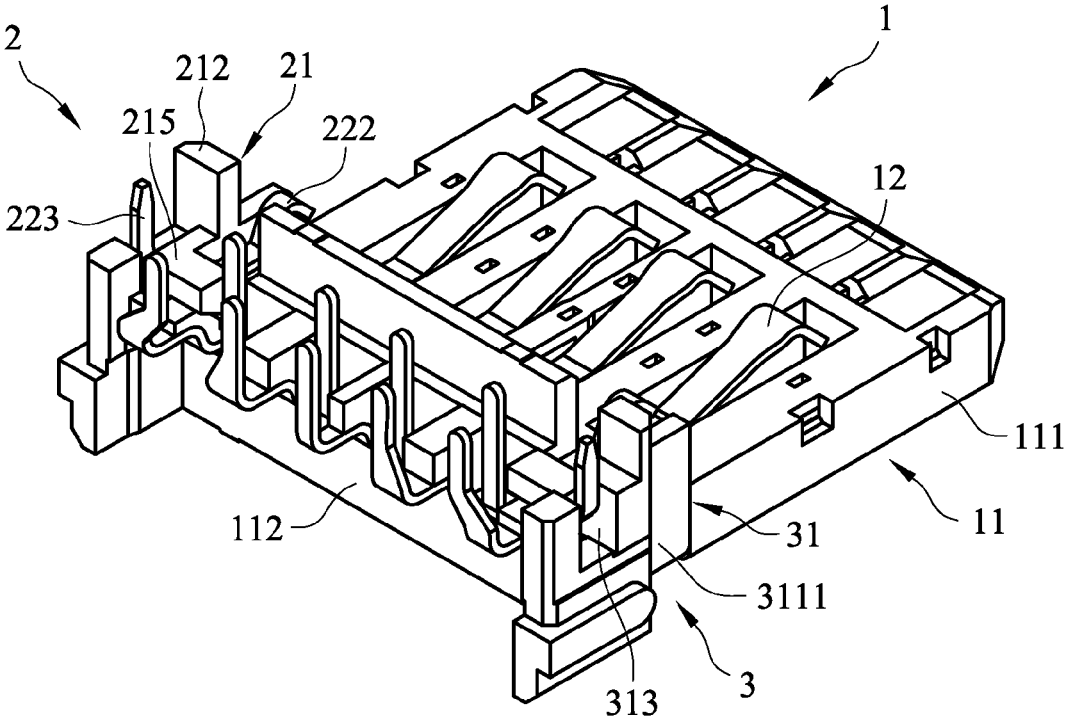
FIG. 3 is a stereo appearance schematic of the first embodiment according to the present invention from another perspective.
Figure 4:
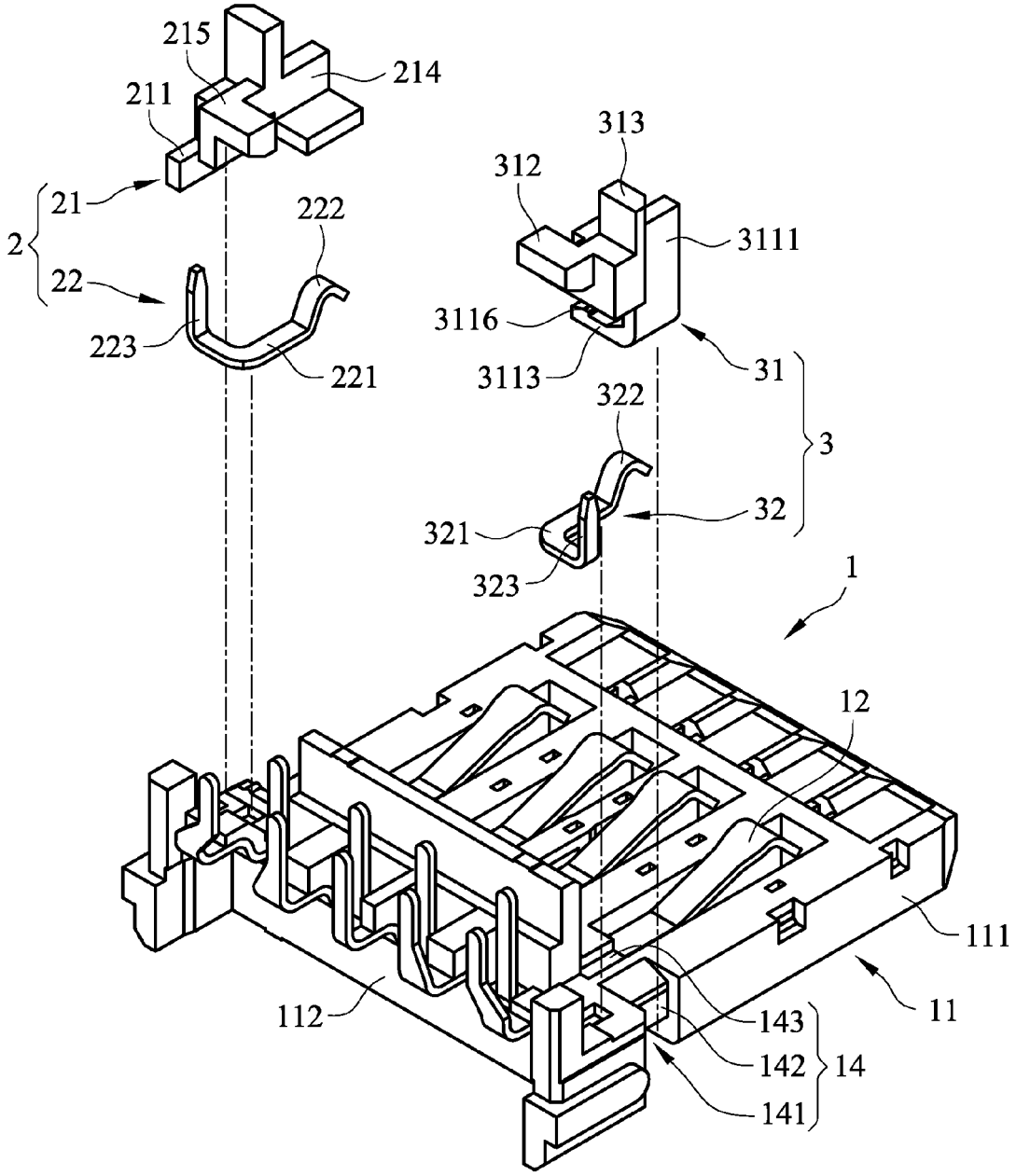
FIG. 4 is a stereo exploded schematic of the first embodiment according to the present invention from another perspective.
Figure 5:
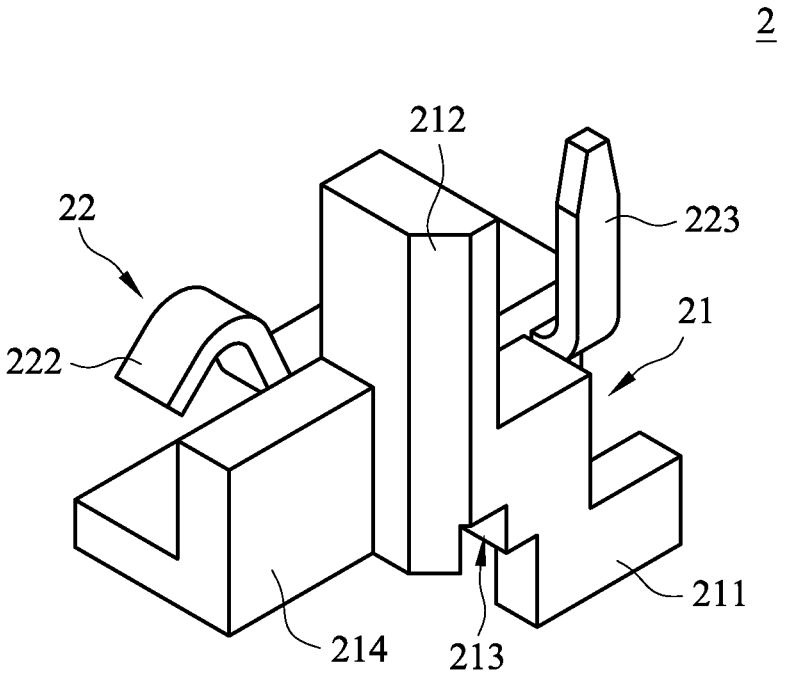
FIG. 5 is an appearance schematic of the first detection module in the first embodiment according to the present invention.
Figure 6:
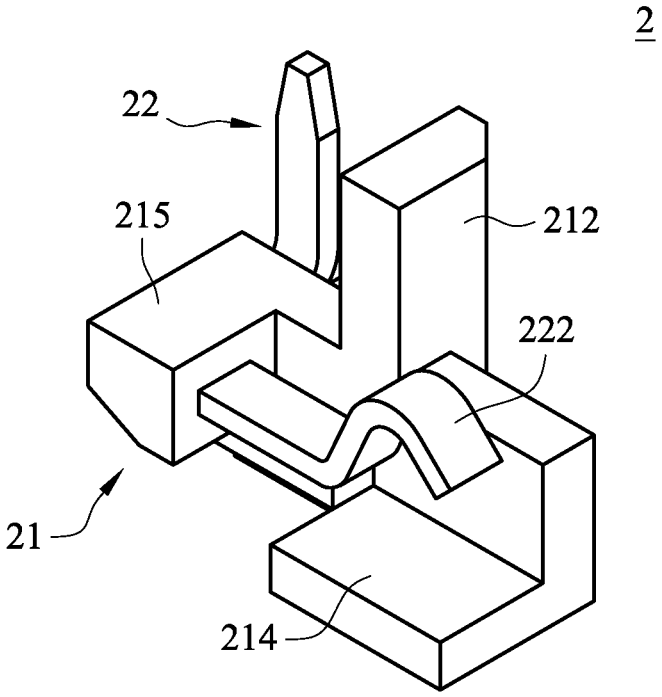
FIG. 6 is an appearance schematic of the first detection module in the first embodiment according to the present invention from another perspective.
Figure 7:
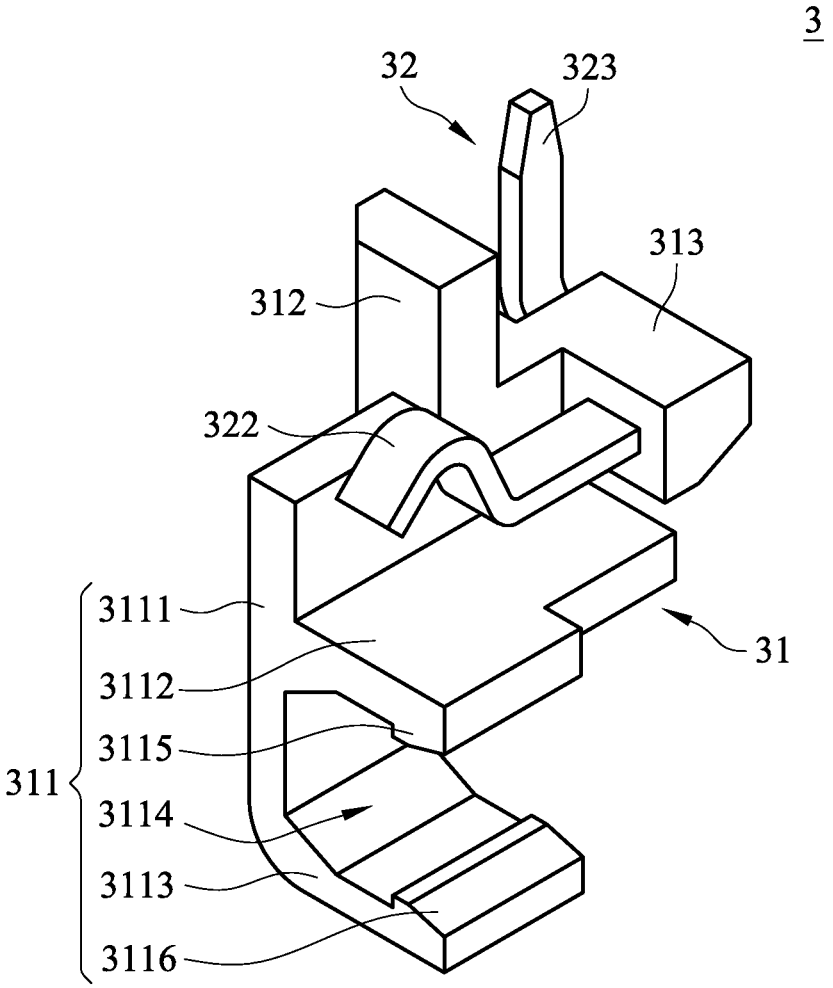
FIG. 7 is an appearance schematic of the second detection module in the first embodiment according to the present invention.
Figure 8:
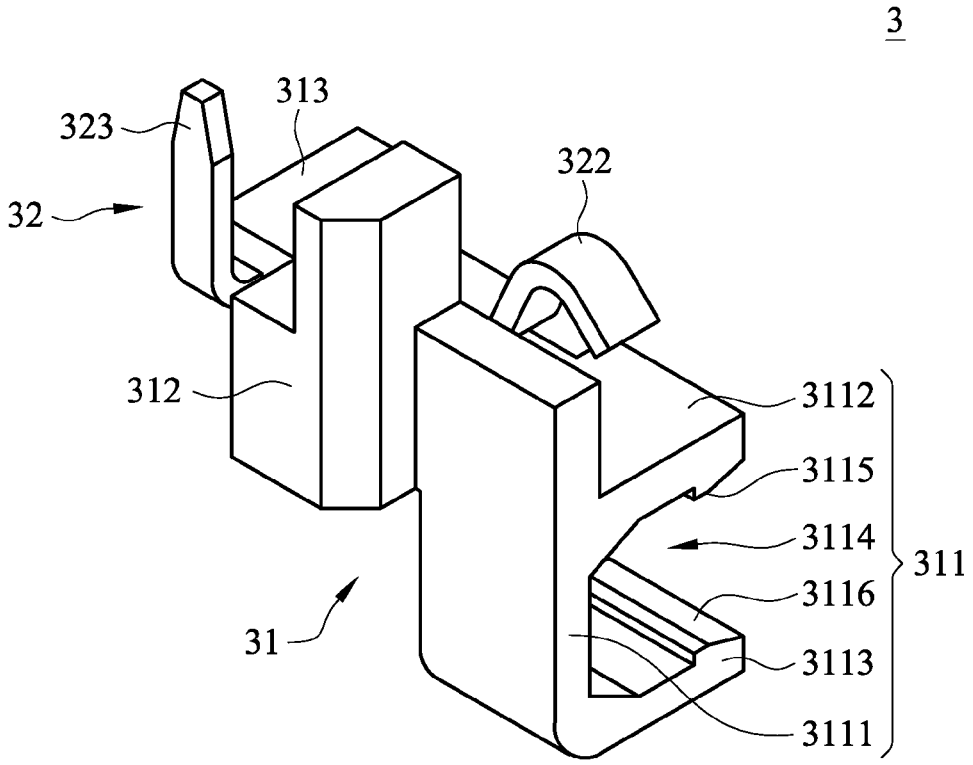
FIG. 8 is an appearance schematic of the second detection module in the first embodiment according to the present invention from another perspective.
Figure 9:
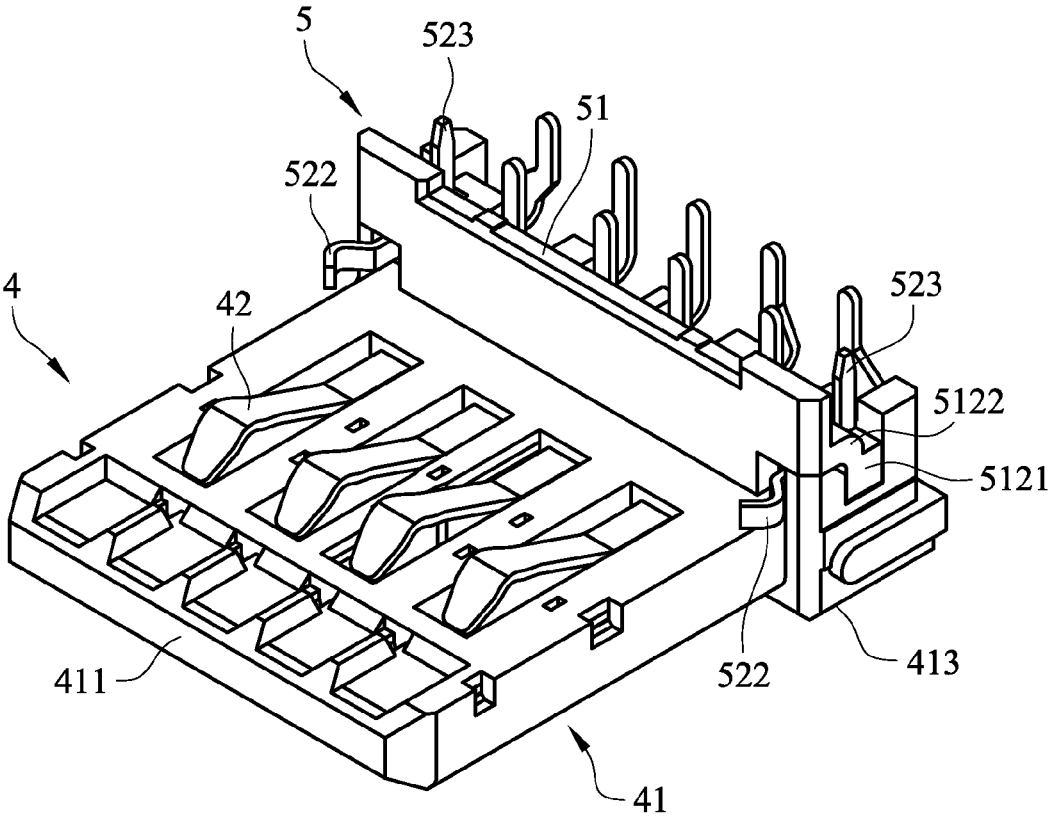
FIG. 9 is a stereo appearance schematic of the second embodiment according to the present invention.
Figure 10:
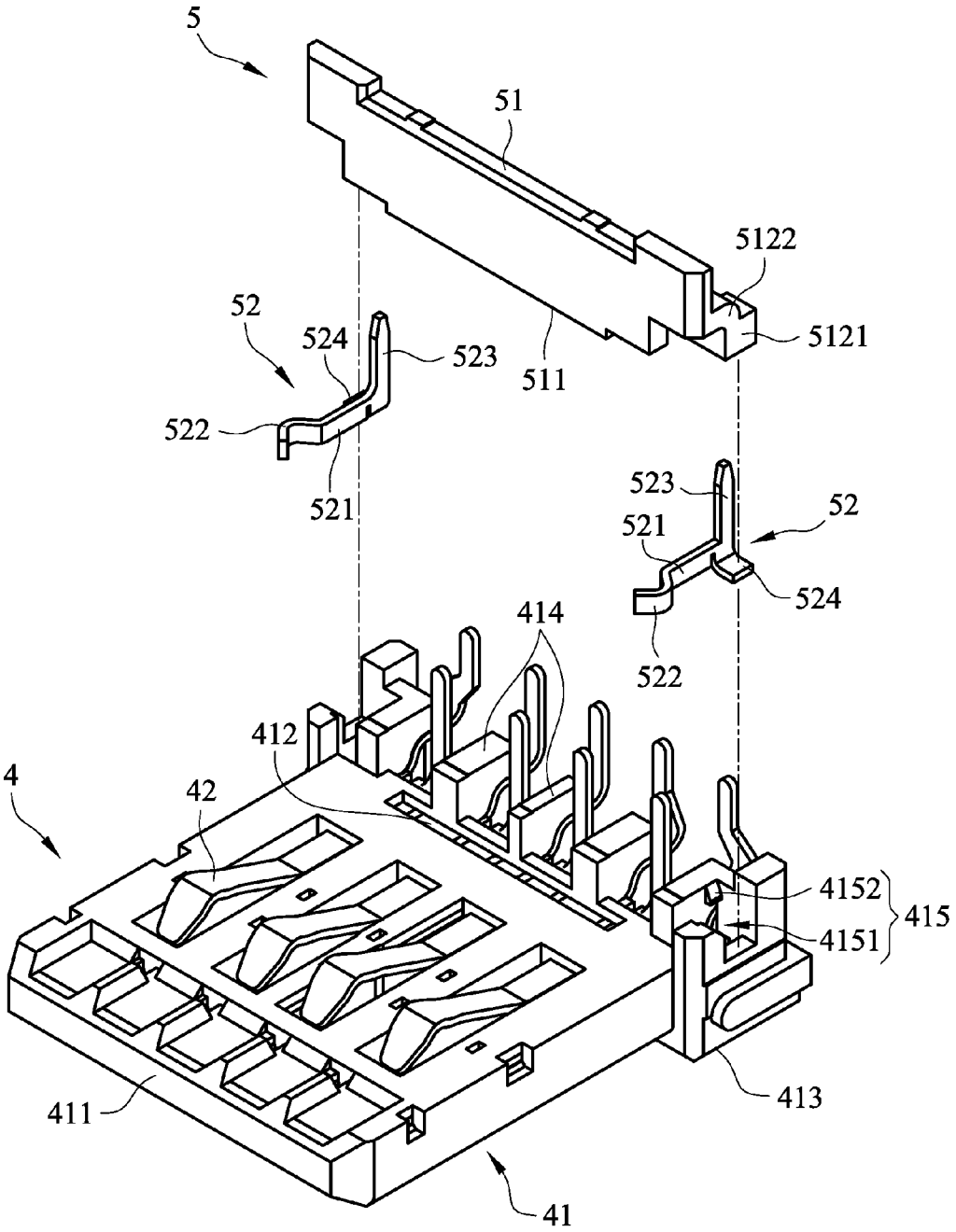
FIG. 10 is a stereo exploded schematic of the second embodiment according to the present invention.
Figure 11:
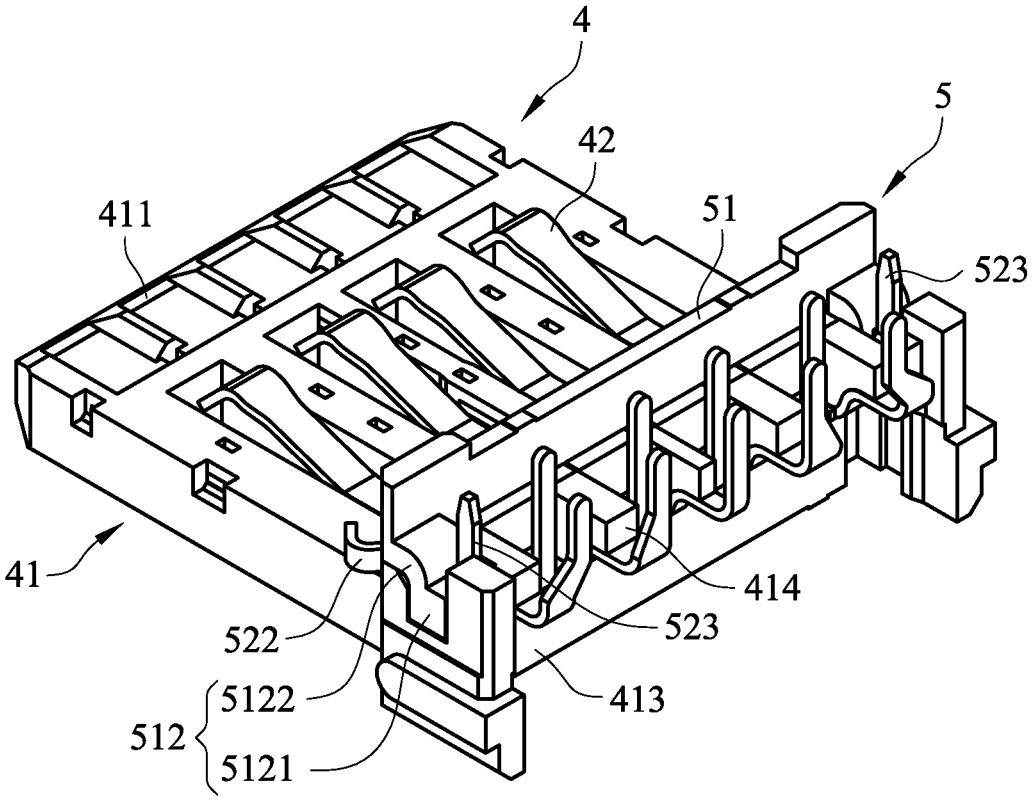
FIG. 11 is a stereo appearance schematic of the second embodiment according to the present invention from another perspective.
Figure 12:
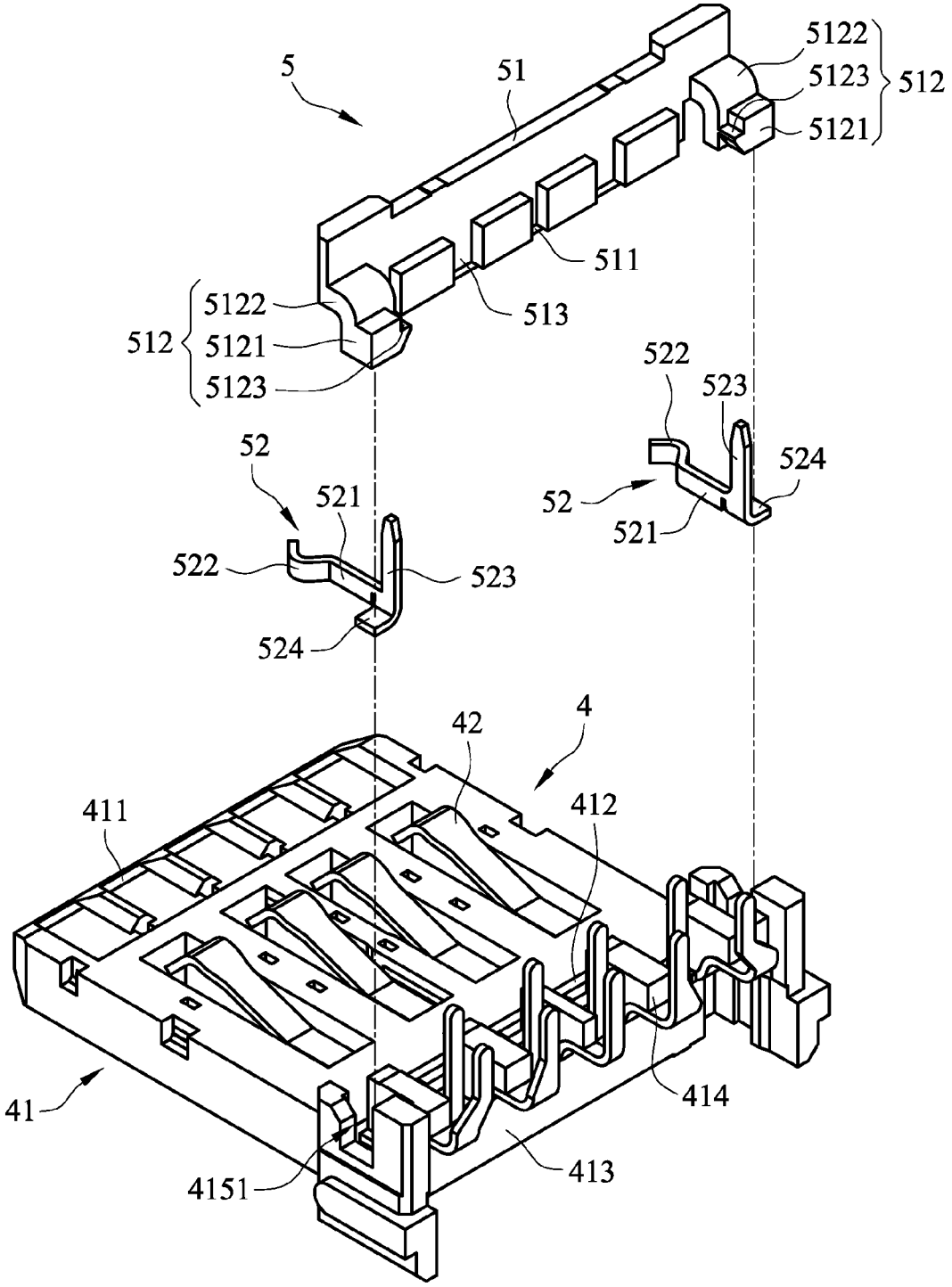
FIG. 12 is a stereo exploded schematic of the second embodiment according to the present invention from another perspective.
Figure 13:
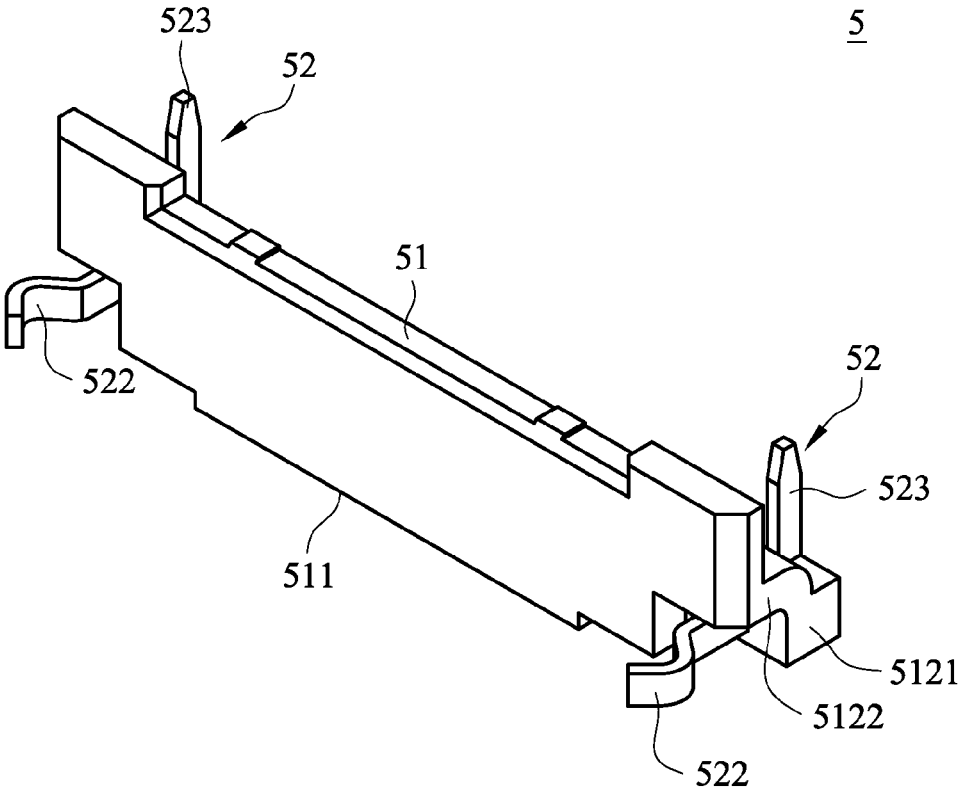
FIG. 13 is an appearance schematic of the detection module in the second embodiment according to the present invention.
Figure 14:
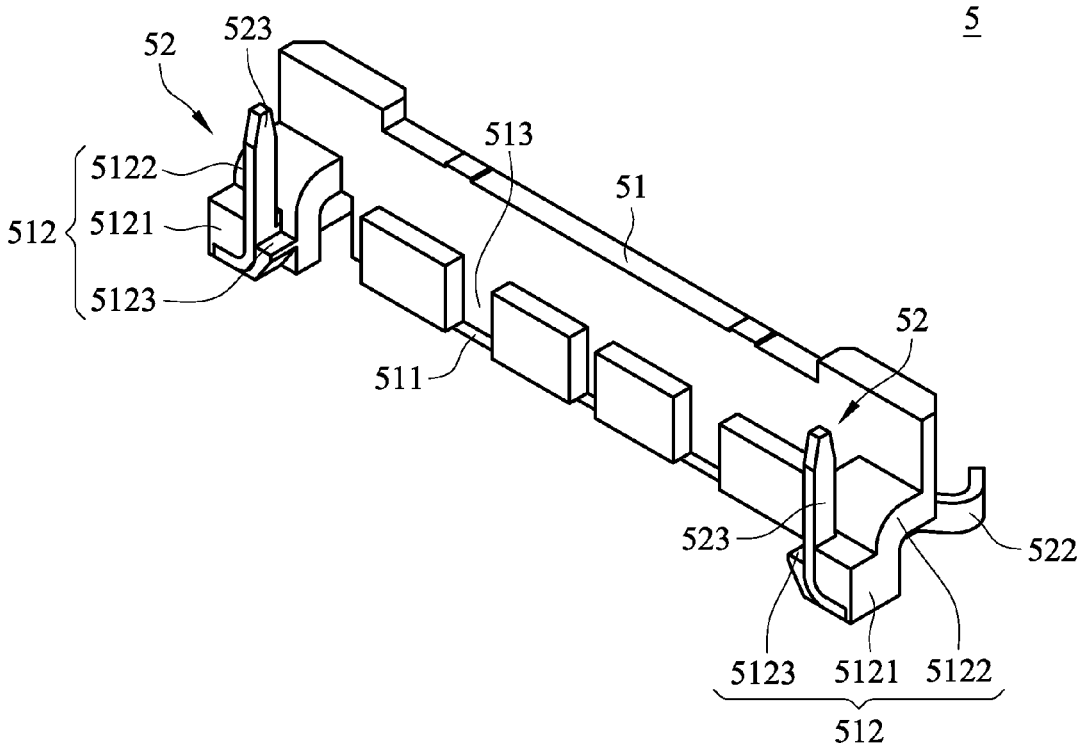
FIG. 14 is an appearance schematic of the detection module in the second embodiment according to the present invention from another perspective.

In order for understanding the objectives, features, and effects of the present invention fully, the present invention is described in detail as below by means of the following embodiments in conjunction with attached drawings.

Refer to FIGS. 1 to 8, which shows the stereo appearance schematic of the first embodiment according to the present invention, the stereo exploded schematic of the first embodiment according to the present invention, the stereo appearance schematic of the embodiment according to the present invention from another perspective, the stereo exploded schematic of the first embodiment according to the present invention from another perspective, the appearance schematic of first detection module in the first embodiment according to the present invention, the appearance schematic of first detection module in the first embodiment according to the present invention from another perspective, the appearance schematic of second detection module in the first embodiment according to the present invention, and the appearance schematic of second detection module in the first embodiment according to the present invention from another perspective. As shown in the figures, the present invention is a modular inserted connector detecting structure, which is composed of at least a connector 1, a first detection module 2 and a second detection module 3.

The connector 1 stated above may be an USB3.0 connector, which comprises an insulation body 11, and multiple signal terminals 12 provided on the insulation body 11, and the insulation body 11 comprises a tongue 111, a base 112 connecting with the tongue 111, a first engagement portion 13 provided on the base 112, and a second engagement portion 14 provided on the tongue 11, for one end of the signal terminal 12 to be provided on the tongue 111, while the other end to protrude out from the base 112, wherein the first engagement portion 13 comprises a limiting area 131, and an extending portion 132 provided on the base 112 and located on one side of the limiting area 131, in addition, the second engagement portion 14 comprises a recess area 141 provided on one side of the tongue 111, a bump 142 provided in the recess area 141, and fastening troughs 143 provided on both surfaces of the tongue 111 and adjacent to the bump 142, respectively.

The first detection module 2 joins with the insulation body 11, which comprises a first retaining bracket 21 arranged on the insulation body 11, and a first detection terminal 22 provided on the first retaining bracket 21, and the first retaining bracket 21 provided on the first detection module 2 joins with the first engagement portion 13, wherein the first retaining bracket 21 comprises a fixing portion 211 joining with the limiting area 131, a vertical wall 212 extended and provided on the fixing portion 211, a slot 213 provided on one end surface of the vertical wall and butting with the extending portion 132, an angle block 214 extended and provided on one side of the vertical wall 212 and abutting against the tongue 111, a mounting portion 215 extended and provided on one side of the vertical wall 212 and abutting against the base 112, while the first detection terminal 22 comprises a connection section 221 in a bending form, a contact end 222 provided on one end of the connection section 221, and a soldering end 223 provided on the other end of the connection section 221, the connection section 221 is provided in the mounting portion 215, the contact end 222 protrudes out from the mounting portion 215 and corresponds to the angle block 214, and the soldering end 223 protrudes out from the mounting portion 215 and is in the same direction as the vertical wall 212.

The second detection module 3 joins with the insulation body 11, which comprises a second retaining bracket 31 arranged on another side of the insulation body 11, and a second detection terminal 32 provided on the second retaining bracket 31, and the second retaining bracket 31 provided on the second detection module 3 joins with the second engagement portion 14, while the second retaining bracket 31 comprises a clamping portion 311, a vertical wall 312 provided on one side of the clamping portion 311, and a mounting portion 313 provided on one side of the vertical wall 312, the clamping portion 311 is joined in the recess area 141 of the second engagement portion 14, and clamps the bump 142 and is snapped in each of the fastening troughs 143, wherein the clamping portion 311 comprises a side slab 3111, an upper slab 3112 provided on one side of the side slab 3111, a lower slab 3113 provided on one side of the side slab 3111 and corresponds to the upper slab 3112, a butting area 3114 formed between the upper slab 3112 and the lower slab 3113, and an upper hooking block 3115 and a lower hooking block 3116 provided on corresponding surface of the upper slab 3112 and the lower slab 3113, such that the upper hooking block 3115 and the lower hooking block 3116 snap each of the fastening troughs 143 after the butting area 3114 clamps bump 142, in addition, the second detection terminal 32 comprises a connection section 321 in a bending form, a contact end 322 provided on one end of the connection section 321, and a soldering end 323 provided on the other end of the connection section 321, the connection section 321 is provided in the mounting portion 313, the contact end 322 protrudes out from the mounting portion 313 and corresponds to the clamping portion 311, while the soldering end 323 protrudes out from the mounting portion 313 and is in the same direction as the vertical wall 312.

In assembly, the first detection module 2 and the second detection module 3 may be joined on two sides of the insulation body 11 directly; while in assembling the first detection module 2, the fixing portion 211 of the first retaining bracket 21 thereof is joined with the limiting area 131 of the first engagement portion 13 correspondingly, such that the slot 213 on one end surface of the vertical wall 212 butts the extending portion 132, the angle block 214 abuts against the tongue 111, and the mounting portion 215 abuts against the base 112; in addition, in assembling the second detection module 3, the clamping portion 311 of the second retaining bracket 31 thereof joins with the recess area 141 of the second engagement portion 14 correspondingly, such that the clamping portion 311 is clamped on the outer edge of the bump 142 of the second engagement portion 14 by the butting area 3114 thereof, for the side slab 3111, the upper slab 3112 and the lower slab 3113 of the clamping portion 311 to abut against three surfaces on the outer edge of the bump 142, respectively, and at the same time, for the upper hooking block 3115 and the lower hooking block 3116 to be snapped in each of the fastening troughs 413 of the second engagement portion 14; as such, the assembly of the first detection module 2 and the second detection module 3 may be accomplished, after that, the exterior of the connector 1, first detection module and second detection module 3 is covered by a shielding housing (not shown) to accomplish the required USB 3.0 connector structure in order for the achievement of the effects of simple structure, convenient assembly, robust joining and facility to production and manufacturing.

Refer to FIGS. 9 to 14, which show the stereo appearance schematic of the second embodiment according to the present invention, the stereo exploded schematic of the second embodiment according to the present invention, the stereo appearance schematic of the second embodiment according to the present invention from another perspective, the stereo exploded schematic of the second embodiment according to the present invention from another perspective, the appearance schematic of the detection module in the second embodiment according to the present invention, and the appearance schematic of the detection module in the second embodiment according to the present invention from another perspective. As shown in the figures, the present invention is an embedded detection module of a connector, which is composed of at least a connector 4 and a detection module 5.

The connector 4 stated above may be an USB3.0 connector, which comprises a insulation body 41, and multiple signal terminals 42 provided on the insulation body 41, while the insulation body 41 comprises a tongue 411, a rabbet 412 provided on one surface of the tongue 411, a base 413 connecting with the tongue 411, multiple separation portions 414 provided on the base 413, and the engagement troughs 414 provided on two sides of the base 413, respectively for one end of the signal terminal 42 to be provided on the tongue 411, and the other end protrudes out between the separation portions 414 of the base 413, wherein the engagement troughs 415 comprises a limiting area 4151, and a stopping portion 4152 provided on one inner wall of the limiting area 4151.

The detection module 5 joins with the insulation body 41, which comprises a scarfing seat 51 arranged on one surface of the insulation body 41, and two detection terminals 52 provided on two sides of the scarfing seat 51, respectively, and the scarfing seat 51 provided in the detection module 5 joins with the rabbet 412 and the engagement troughs 415, while the bottom surface of the scarfing seat 51 is provided with a butting portion 2511 joining with the rabbet 512, and the two sides of the scarfing seat 51 are provided with a retaining bracket 512 joining with the engagement troughs 415 thereon, and on surface of the scarfing seat 51 is provided with multiple grooves 513 engaged with each of the separation portions 414, wherein the retaining bracket 512 comprises a fixing portion 5121 joined in the limiting area 4152, an extension section provided between the scarfing seat 51 and the fixing portion 5121 and abutting against one side edge of the limiting area 4152, and a notch 5123 provided on the top surface of the fixing portion 5121 and abutting the stopping portion 4152, the extension section 5122 extends forward one side of the scarfing seat for the fixing portion 5121 and the scarfing seat 51 located in different planes to make a back and front difference, in addition, the detection terminals 52 comprises a connection section 521, a contact end 522 provided on one end of the connection section 521, a soldering end 523 provided on the other end of the connection section 521, and a intervening portion 524 provided on one side of the connection section 521, the connection section 521 and the intervening portion 524 are provided in the fixing portion 5121, the contact end 22 protrudes out from the fixing portion 5121 and the scarfing seat 51 and corresponds to the extension section 5122, while the soldering end 53 protrudes out from the fixing portion 5121 and is in the same direction as the scarfing seat 51.

In assembling, the detection module 5 may be joined on one surface of the insulation body 41 directly; nevertheless, in assembling the detection module 5, the butting portion 511 on the bottom and the retaining brackets 512 on two sides of the scarfing seat 41 thereof join with the rabbet 412 and the engagement troughs 415 of the insulation body 41 correspondingly, and simultaneously, each of the grooves 513 on one surface of the scarfing seat 51 is engaged with each of the separation portions 414 on the base 413 mutually, such that the butting portion 511 is plugged in the rabbet 412 directly, and each of the grooves 513 is engaged with each of the separation portions 414 mutually, while each of the retaining brackets 512 is joined in the limiting area 4142 with the fixing portion 5121 thereof, such that the notch 5123 of the fixing portion 5121 and the stopping portion 4152 abut mutually, furthermore, since the fixing portion 5121 and the scarfing seat 51 are in different planes to form a back and front difference, the extension section 5122 is allowed to abut against one side edge of the limiting area 4152, as such, the assembly of the detection module may be accomplished, after that, the exterior of the connector 4 and the detection module 5 is covered with a shielding housing (not shown) to accomplish the required USB 3.0 connector structure in order to achieve the effects of simple structure, easy assembly, robust joining, and facility to produce and manufacture.

Figure 15:
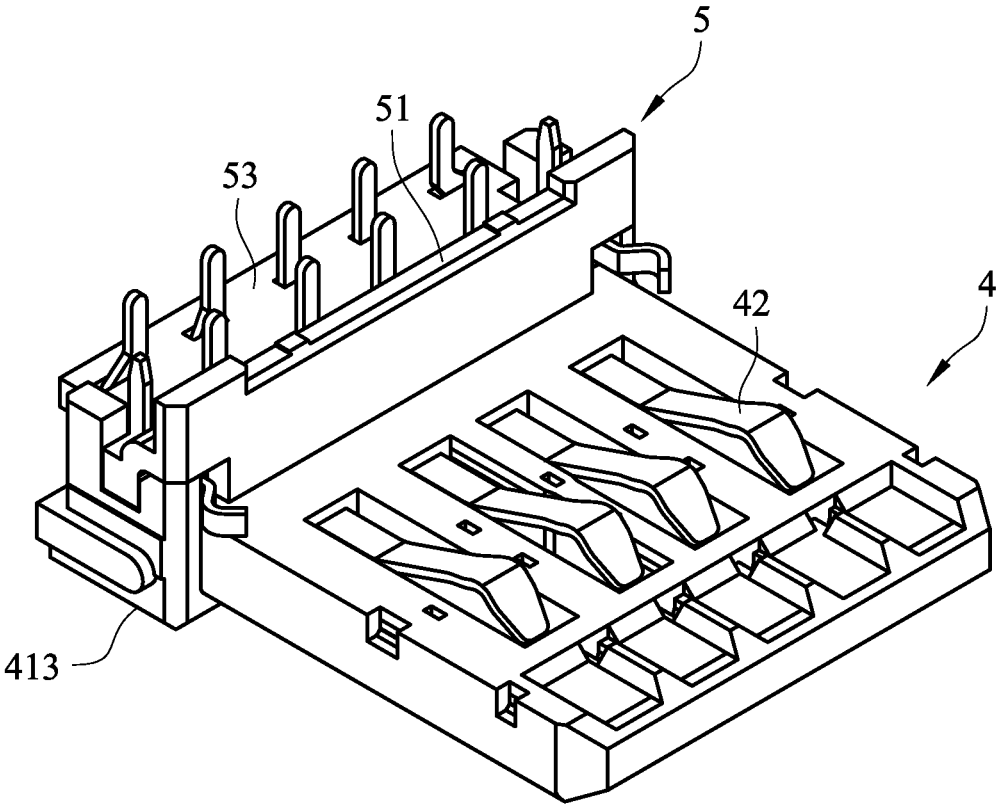
FIG. 15 is a stereo appearance schematic of the third embodiment according to the present invention.
Figure 16:
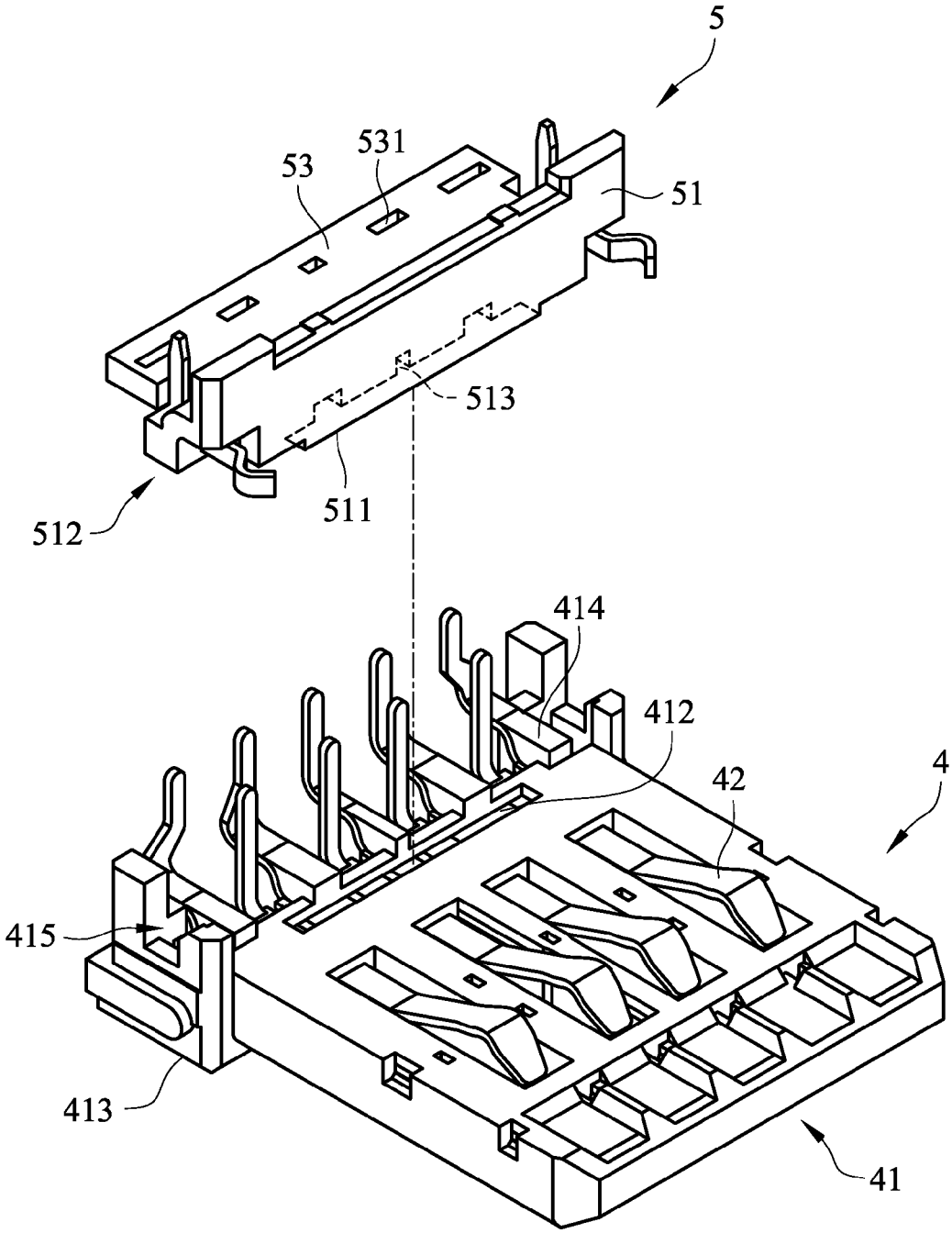
FIG. 16 is a stereo exploded schematic of the third embodiment according to the present invention.

Refer to FIGS. 15 and 16, which show the stereo appearance schematic of the third embodiment according to the present invention and the stereo exploded schematic of the third embodiment according to the present invention. As shown in the figures, besides of the structure form disclosed in the first and the second embodiments, the detection module 5 of the present creation may be the structure of the third embodiment with difference in that one surface of the scarfing seat 51 is further provided with a back cover 53 thereon, and the back cover 53 is located above each of the grooves 513, as well as the back cover 53 is provided with multiple limiting holes 531 thereon.

As the detection module 5 of this embodiment has the butting portion 511 on the bottom and the retaining brackets 512 on both sides of the scarfing seat 51 thereof to join correspondingly with the rabbet 412 of the insulation body 41 and the engagement troughs 415, respectively, not only each of the grooves 513 on one surface of the scarfing seat 51 are engaged with each of the separation portions 414 on the base 413 mutually, but also the other end of each of the signal terminals 42 penetrates in each of the limiting holes 531 on the back cover 53, as such, while the effects the same as the previous embodiment may be also achieved, further each of the signal terminals 42 may be limited and separated, in order to avoid short circuit generated by mutual contact between each of the signal terminals 42 and the shielding housing (not shown).

Figure 17:
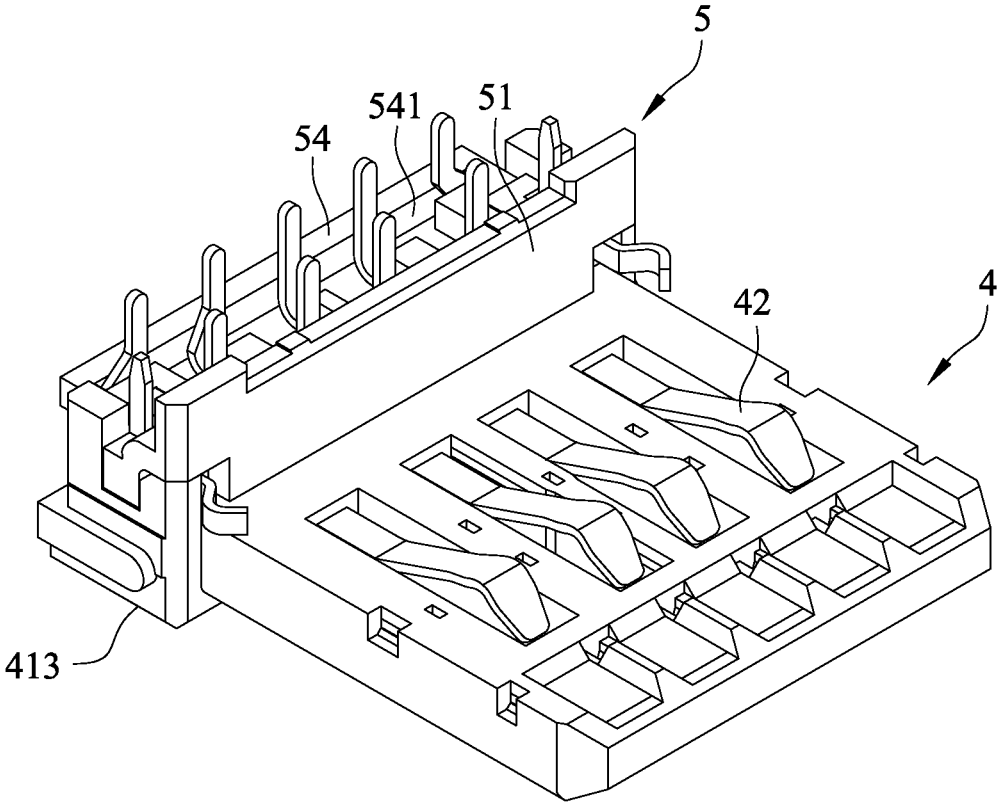
FIG. 17 is a stereo appearance schematic of the fourth embodiment according to the present invention.
Figure 18:
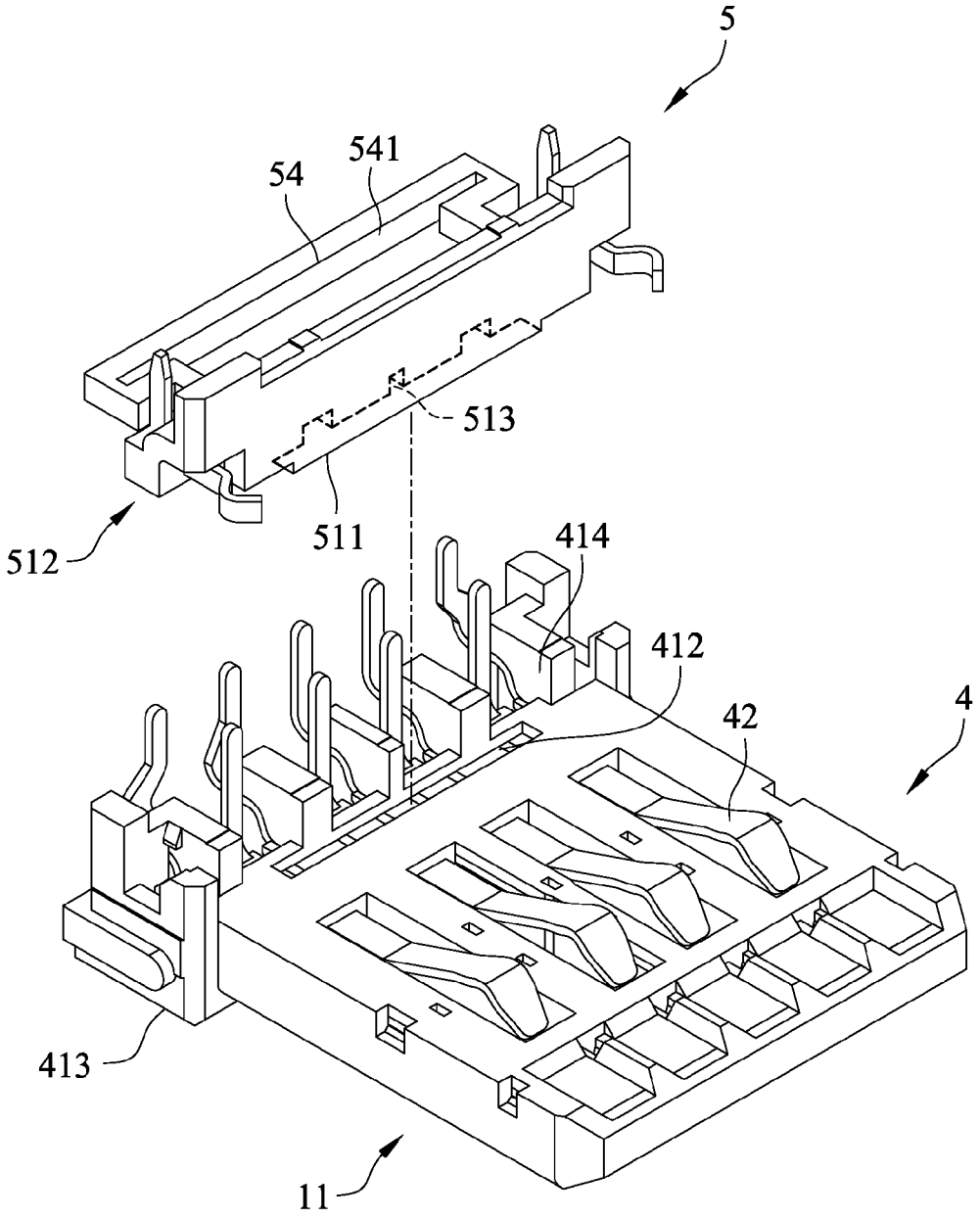
FIG. 18 is a stereo exploded schematic of the fourth embodiment according to the present invention.
Figure 19:
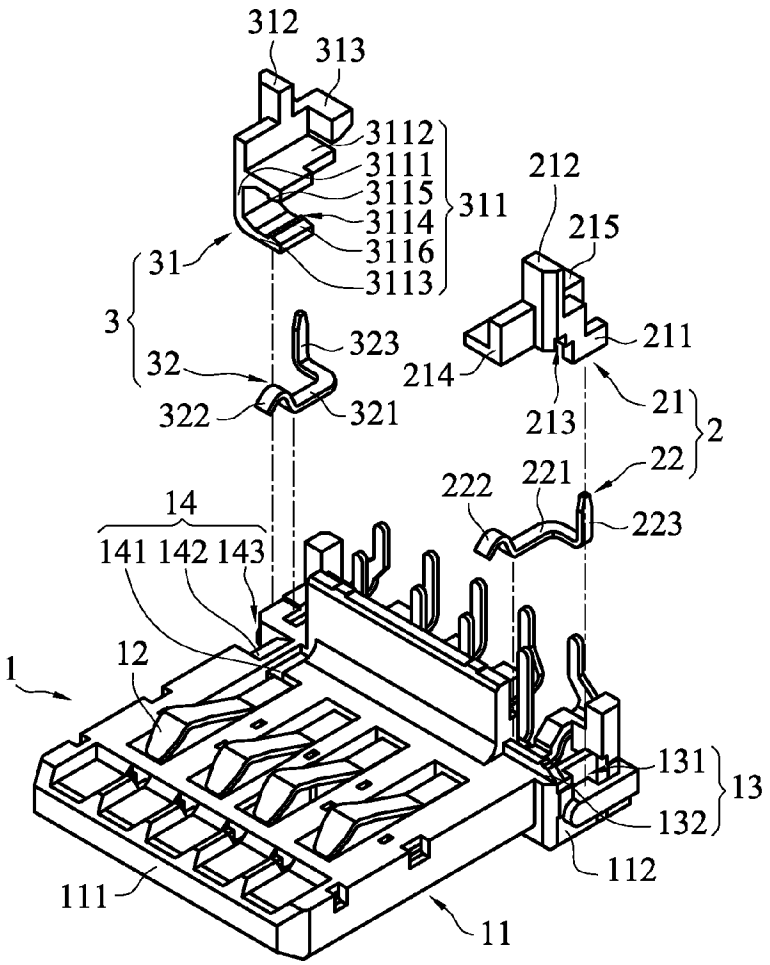
FIG. 19 are the stereo appearance schematic of the first and the second embodiments according to the present invention.
Figure 19:
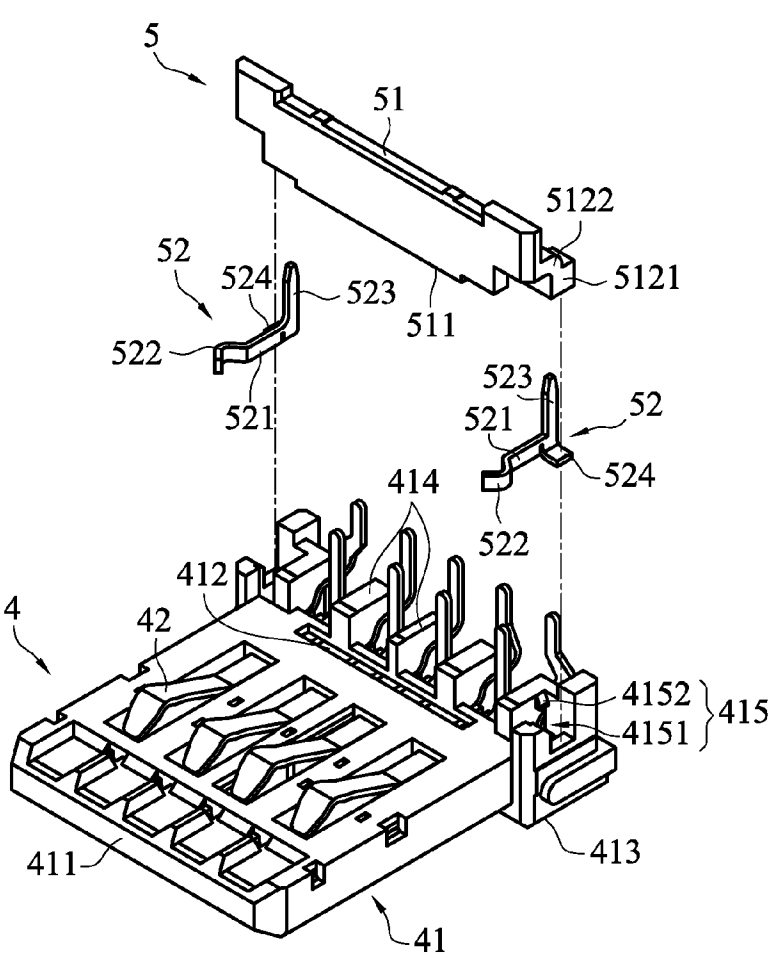

Refer to FIGS. 17 and 18. As shown in the figures, they show the stereo appearance schematic of the fourth embodiment according to the present invention and the stereo exploded schematic of the fourth embodiment according to the present invention. As shown in the figures, besides the structures disclosed in the above first, second and third embodiments, the detection module 2 of the present invention may further be the structure of the fourth embodiment with difference in that a back cover 54 may be further provided on one surface of the scarfing seat 5, and the back cover 54 is located above each of the grooves 513, furthermore, the back cover 54 is provided with an elongated hole 541 thereon.

As the detection module 5 of this embodiment has the butting portion 511 on the bottom and the retaining brackets 512 on two sides of the scarfing seat 51 thereof to join correspondingly with the rabbet 412 and the engagement troughs 415 of the insulation body 41, not only each of the grooves 513 on one surface of the scarfing seat 51 is engaged with each of the separation portions 414 on the base 413 mutually, but also the other end of each of the signal terminals 42 penetrates in the elongated hole 541 on the back cover 54, as such, while the same effects as the previous embodiment may be achieved, further each of the signal terminals 42 is limited and separated in order for the avoidance of short circuit generated by the mutual contact between each of the signal terminals 42 and the shielding housing (not shown).

In summary, from the contents disclosed in detail, the new model does achieve the expected objectives of the invention by such a modular embedded connector detecting structure that in assembly, the first and second detection modules join directly on two sides of the insulation body, or the scarfing seat of the detection module joins directly on the insulation body, such that the effects of simple structure, convenient assembly, robust joining and facility to produce and manufacture are achieved.

What is claimed is:

1. A modular inserted connector detecting structure, comprising:

a connector comprising an insulation body, and multiple signal terminals provided on the insulation body;

a first detection module joining with the insulation body, which comprises a first retaining bracket arranged on one side of the insulation body, and a first detection terminal provided on the first retaining bracket; and a second detection module joining the insulation body, which comprises a second retaining bracket arranged on another side of the insulation body, and a second detection terminal arranged on the second retaining bracket, wherein the insulation body comprises a tongue, a base connecting with the tongue, a first engagement portion provided on the base, a second engagement portion provided on the tongue, such that one end of the signal terminal is provided on the tongue, while the other end protrudes out from the base, and the first retaining bracket provided on the first detection module joins with the first engagement portion, the second retaining bracket provided on the second detection module joins with the second engagement portion, while the first engagement portion comprises a limiting area and an extending portion provided on the base and located on one side of the limiting area.

2. The modular inserted connector detecting structure as claim 1, wherein the first retaining bracket comprises a fixing portion joining with the limiting area, a vertical wall extended and provided on the fixing portion, a slot provided on one end surface of the vertical wall and butting with the extending portion, an angle block extended and provided on one side of the vertical wall and abutting against the tongue, and a mounting portion extended and provided on one side of the vertical wall and abutting against the base, while the first detection terminal comprises a connection section in a bending form, a contact end provided on one end of the connection section, and a soldering end provided on the other end of the connection section, connection section is provided in the mounting portion, the contact end protrudes out from the mounting portion and corresponds to the angle block, and the soldering end protrudes out from the mounting portion and is in the same direction as the vertical wall.

3. The modular inserted connector detecting structure as claim 1, wherein the second engagement portion comprises a recess area provided on one side of the tongue, a bump provided in the recess area, and fastening troughs provided on both surfaces of the tongue and adjacent to the bump, respectively, and the second retaining bracket comprises a clamping portion, a vertical wall provided on one side of the clamping portion, and a mounting portion provided on one side of the vertical wall, while the clamping portion is joined in the recess area of the second engagement portion, and clamps the bump and is snapped in each of the fastening troughs.

4. The modular inserted connector detecting structure as claim 3, wherein the second detection terminal comprises a connection section in a bending form, a contact end provided on one end of the connection section, and a soldering end provided on the other end of the connection section, the connection section is provided in the mounting portion, and the contact end protrudes out from the mounting portion and corresponds to the clamping portion, while the soldering end protrudes out from the mounting portion and is in the same direction as the vertical wall, and the clamping portion comprises a side slab, an upper slab provided on one side of the side slab, a lower slab provided on one side of the side slab and corresponds to the upper slab, a butting area formed between the upper slab and the lower slab, and an upper hooking block and a lower hooking block provided on corresponding surfaces of the upper slab and the lower slab, respectively, such that the upper hooking block and the lower hooking block snap each of the fastening troughs after the butting area clamps the bump, respectively.

5. A modular inserted connector detecting structure, wherein the detecting structure comprises:

a connector comprising an insulation body, and multiple signal terminals provided on the insulation body; and a detection module joining with the insulation body, which comprises a scarfing seat arranged on one surface of the insulation body, and two detection terminals provided on two sides of the scarfing seat, respectively, wherein the insulation body comprises a tongue, a rabbet provided on one surface of the tongue, a base connecting with the tongue, multiple separation portions provided on the base, and engagement troughs provided on two sides of the base, such that one end of the signal terminal is provided on the tongue, and the other end protrudes out between the separation portions of the base, and the scarfing seat provided on the detection module joins with the rabbet and the engagement trough, while the engagement trough comprises a limiting area, a stopping portion provided on one inner wall of the limiting area.

6. The modular inserted connector detecting structure as claim 5, wherein a bottom surface of the scarfing seat provided on the detection module is provided with a butting portion joining with the rabbet, and two sides of the scarfing seat are provided, respectively, with a retaining bracket joining with the engagement troughs, and multiple grooves engaged with each of the separation portions are provided on one surface of the scarfing seat, while the retaining bracket comprises a fixing portion joining in the limiting area, an extension section provided between the scarfing seat and the fixing portion and abutting against one side edge of the limiting area, and a notch provided on the top surface of the fixing portion and abutting the stopping portion, and the extension section extends toward one side of the scarfing seat, such that the fixing portion and the scarfing seat are located in different planes to make a back and front difference, in addition, the detection terminal provided on the detection module comprises a connection section, a contact end provided on one end of the connection section, a soldering end provided on the other end of the connection section, and an intervening portion provided on one side of the connection section, the connection section and the intervening portion are provided in the fixing portion, the contact end protrudes out from the fixing portion and the scarfing seat and corresponds to the extension section, and the soldering end protrudes out from the fixing portion and is in the same direction as the scarfing seat.

7. The modular inserted connector detecting structure as claim 5, wherein a back cover is further provided on one surface of the scarfing seat, and the back cover is above each of the grooves, and multiple limiting holes for the other end of each of the signal terminals to penetrate are provided on the back cover.

8. The modular inserted connector detecting structure as claim 5, wherein a back cover is further provided on one surface of the scarfing seat, and the back cover is above each of the grooves, and an elongated hole for the other end of each of the signal terminals to penetrate is provided on the back cover.

* * * * *